US009410387B1

(12) United States Patent
Gao

(10) Patent No.: US 9,410,387 B1
(45) Date of Patent: Aug. 9, 2016

(54) AUTOMATIC ROCK DEBRIS CATCHING AND WASHING APPARATUS

(71) Applicant: SHIJIAZHUANG SHENGSHITIANCHENG INFO TECHNOLOGY CO. LTD., Shijiazhuang (CN)

(72) Inventor: Xing Gao, Shijiazhuang (CN)

(73) Assignee: SHIJIAZHUANG SHENGSHITIANCHENG INFO TECHNOLOGY CO. LTD. (CN)

( * ) Notice: Subject to any disclaimer, the term of this patent is extended or adjusted under 35 U.S.C. 154(b) by 0 days.

(21) Appl. No.: 14/747,151

(22) Filed: Jun. 23, 2015

(30) Foreign Application Priority Data

Mar. 23, 2015 (CN) ..... 2015 1 0127371

(51) Int. Cl.

| | |
|---|---|
| ***B07B 9/00*** | (2006.01) |
| ***E21B 21/06*** | (2006.01) |
| ***B08B 1/00*** | (2006.01) |
| ***B08B 1/04*** | (2006.01) |
| ***B08B 3/04*** | (2006.01) |

(52) U.S. Cl.
CPC ..... *E21B 21/066* (2013.01); *B08B 1/002* (2013.01); *B08B 1/04* (2013.01); *B08B 3/04* (2013.01)

(58) Field of Classification Search
CPC ..... E21B 21/066; B08B 1/002; B08B 1/04
USPC ..... 209/12.1, 17, 18, 270, 288
See application file for complete search history.

(56) References Cited

U.S. PATENT DOCUMENTS

| | | | | |
|---|---|---|---|---|
| 5,445,730 | A * | 8/1995 | Pattee | B08B 3/14 210/167.31 |
| 6,582,610 | B2 * | 6/2003 | Williams | C02F 1/385 106/757 |
| 8,381,916 | B2 * | 2/2013 | Bossen | B03B 5/00 209/270 |
| 2005/0098484 | A1 * | 5/2005 | Johannsen | B03B 5/42 209/288 |

* cited by examiner

*Primary Examiner* — Terrell Matthews
(74) *Attorney, Agent, or Firm* — Ostrolenk Faber LLP

(57) ABSTRACT

The present invention provides an automatic rock debris catching and washing apparatus comprising an acquisition device, a filtration device, a collection device and a controlling device. The automatic rock debris catching and washing apparatus has a fully automatic operation, and during use, it is not necessary to real-time monitor the working condition of the catching and washing apparatus by manpower, and collecting regularly the rock debris gathered within the sand storing cylinders is enough. It is highly adaptable to harsh environment due to using the mechanized processing, and the interval, rate and so on of collecting the rock debris can be set with high accuracy, making the analysis on the geological conditions more accurate.

10 Claims, 2 Drawing Sheets

AUTOMATIC ROCK DEBRIS CATCHING AND WASHING APPARATUS

CROSS-REFERENCE TO RELATED APPLICATIONS

The present application claims benefit of Chinese Application no. 20150127371.0 filed Mar. 23, 2015, the content of which are incorporated herein by reference

TECHNICAL FIELD

The present invention relates to the field of petroleum drilling geological logging equipments, and particularly to an automatic rock debris catching and washing apparatus.

BACKGROUND ART

In the process of petroleum drilling, drilling rock debris underground is carried to the ground by mud flowing in high-speed in a drilling tool, and then the debris is filtered out by means of a mud vibration shaker. The geological features at the drilling position are derived by collecting and analyzing the rock debris. For a long time, the rock debris is collected manually at the construction site, and then the rock debris, surfaces of which the drilling mud is adhered to, are cleaned with water, and taken to a geologic room to make geological analysis.

A drilling operation requires dozens of days or several months of drilling, the geological logging requires catching the rock debris samples every 1 to 2 meters, with the shortest sampling interval of 1 to 2 minutes. Every time, the weight of the rock debris is about 500 grams. No matter it is daytime or nighttime or it is rainy or windy, or it is freezing winter or sultry summer, the sampling must be carried out strictly according to the construction schedule. Therefore, it is a heavy work in the case of manual operation, and the working environment is very harsh. Also, it is prone to cause error in the process of manually acquiring rocks, resulting in confusion to the geological analysis of rock debris, directly affecting geological interpretation and effects of petroleum exploration and development.

DISCLOSURE OF THE INVENTION

An object of the present invention is to provide an automatic rock debris catching and washing apparatus, so as to solve the problems in the prior art, which is of harsh working environment and being prone to cause error in the manual collection approach.

The automatic rock debris catching and washing apparatus provided by the present invention comprises an acquisition device, a filtration device, a collection device and a controlling device.

The acquisition device comprises a sand receiver, which comprises a rock debris entrance for receiving the rock debris, wherein the rock debris entrance is disposed opposite to a vibrating screen, the sand receiver has a cylindrical shape and its two ends are connected respectively to a water inlet and a water outlet, which are connected with pipelines respectively.

The filtration device comprises a circulation water tank, the top of which is connected to a first stepping motor. An output shaft of the first stepping motor is connected to a swinging arm, the end of which is provided with a sand filter for collecting the rock debris flowing out of the pipelines. A filtering cylinder is provided below the sand filter, an acquisition plate for collecting foreign substance in the rock debris is provided at the bottom of the filtering cylinder, and a rock debris brush is provided in the filtering cylinder. The circulation water tank is connected to a water discharging pipe. One end of the water discharging pipe is connected to the water inlet of the sand receiver and the water discharging pipe is provided with a first water pump.

Bristles of the rock debris brush are disposed opposite to the acquisition plate, and the rock debris brush is connected with a rotating shaft, which is then connected to a driving shaft. The rotating shaft is coupled to the driving shaft by means of a helical gear. One end of the driving shaft away from the rotating shaft passes through the filtering cylinder and is connected with a driving device. The acquisition plate is connected with a drainage pipe.

The collection device comprises a collection water tank interconnecting with the circulation water tank. A sand receiving funnel for receiving the rock debris from the sand filter is provided on the collection water tank, and the sand receiving funnel is connected with a first fresh water pipe. A rotating disk is provided within the collection water tank and positioned below the sand receiving funnel. A plurality of sand storing cylinders are arranged, in a ring shape, on the rotating disk, at the bottom of which is provided with a second stepping motor.

The controlling device comprises a controller, which is connected to the first water pump, the first stepping motor and the second stepping motor, respectively.

Further, the catching and washing apparatus further comprises a fresh water tank, which is connected to the first fresh water pipe, and the first fresh water pipe is connected with a second water pump connected to the controller.

Further, the fresh water tank is connected to a second fresh water pipe, on which is provided with a third water pump, and the port of the second fresh water pipe is disposed opposite to the bottom of the sand storing cylinders.

Further, the circulation water tank is connected with a water outlet pipe, on which is provided with a fourth water pump connected to the controller.

The top of the inner wall of the circulation water tank is provided with a water level sensor, which is connected to the controller, and one end of the water outlet pipe is connected to a mud pot.

Further, the sand storing cylinder is provided with a middle filter screen at the middle, and a bottom filter screen at the bottom thereof, and the size of meshes of the middle filter screen is greater than that of the meshes of the bottom filter screen.

Further, the catching and washing apparatus further comprises a capturing (camera shooting) device, which comprises an optical lens disposed opposite to the sand storing cylinders.

Further, the outer wall of the sand storing cylinder is divided into two portions along the axial direction of the sand storing cylinder, including a filter screen portion and a glass portion which is disposed opposite to the optical lens.

Further, one end of the driving shaft away from the rotating shaft is provided with a sprocket wheel, the output shaft of the first stepping motor is also provided with a sprocket wheel, and the two sprocket wheels are connected through a chain.

Further, the circulation water tank has a drainage port, which is provided with a solenoid valve.

Further, the pipelines comprise a soft tube, which is connected to the water inlet and the water outlet respectively, and the soft tube is sleeved with a hard tube.

When using the automatic rock debris catching and washing apparatus provided by the present invention, the sand receiver is placed at the outlet of the vibrating screen, wherein water is made to flow in through the water inlet of the sand receiver and mix with the rock debris and then flow out through the water outlet. Since the pipeline connected at the water outlet is oblique, the mixture of the water and the rock debris flows into the filtration device, and completes the acquisition of rock debris.

In the filtration device, the sand filter, when in stationary, is directly aligned with the outlet of the pipeline. The mixture of the water and the rock debris flows to the sand filter and is filtered through the sand filter. The impurity particles after the filtering enter the filtering cylinder. The rock debris on the sand filter will go to the next step after the swinging arm is driven by the first stepping motor. The impurity particles by the filtering enter the filtering cylinder and are further filtered through the filtering cylinder. The impurities by filtering fall onto the acquisition plate. Here, when the swinging arm is driven by the first stepping motor to be rotated, the rock debris brush in the filtering cylinder is driven to be rotated, through a sprocket wheel and a chain, and the impurities on the acquisition plate are discharged out, avoiding accumulation. The water accumulated in the circulation water tank is sent again to the water inlet of the sand receiver through the pipeline, realizing reuse of the water.

After the first stepping motor drives the swinging arm to swing, the rock debris in the sand filter is transported to the sand receiving funnel, on which the rock debris is cleaned by a first fresh water pipe. The rock debris after the cleaning is collected in the sand storing cylinders above the rotating disk, and the plurality of sand storing cylinders rotate continuously under the control of the second stepping motor, so that the plurality of sand storing cylinders can all perform the collection.

The operation through the automatic rock debris catching and washing apparatus is a fully automatic operation. During use, it is not necessary to real-time monitor the working condition of the catching and washing apparatus by manpower, and collecting regularly the rock debris collected in the sand storing cylinders is enough. It is highly adaptable to the harsh environment due to the mechanized operation, and the interval and rate of collecting the rock debris can be set with high accuracy, making the analysis on the geological conditions more accurate.

BRIEF DESCRIPTION OF DRAWINGS

In order to more clearly illustrate the technical solutions of embodiments of the present invention or the prior art, drawings for description of the embodiments or the prior art will be described briefly below. It is obvious that the drawings in the following description only show some embodiments of the present invention, based on which other drawings can be obtained for those ordinary skilled in the art without creative efforts.

Figure 1:
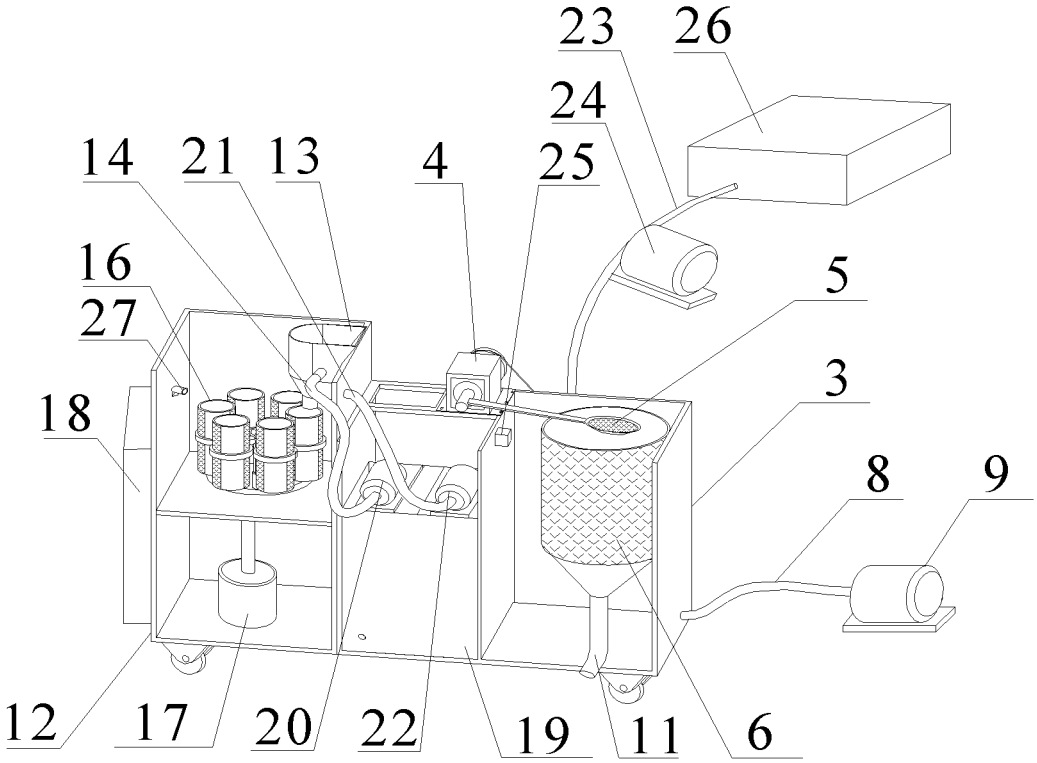
FIG. 1 is a structural schematic diagram of a circulation water tank and a collection water tank of an automatic rock debris catching and washing apparatus provided by an embodiment of the present invention.

| List of reference numbers | |
|---|---|
| 1 - sand receiver; | 2 - rock debris entrance; |
| 3 - circulation water tank; | 4 - first stepping motor; |
| 5 - sand filter; | 6 - filtering cylinder; |
| 7 - rock debris brush; | 8 - water discharging pipe; |
| 9 - first water pump; | 10 - helical gear; |
| 11 - drainage pipe; | 12 - collection water tank; |
| 13 - sand receiving funnel; | 14 - first fresh water pipe; |
| 15 - rotating disk; | 16 - sand storing cylinder; |
| 17 - second stepping motor; | 18 - controller; |
| 19 - fresh water tank; | 20 - second water pump; |
| 21 - second fresh water pipe; | 22 - third water pump; |
| 23 - water outlet pipe; | 24 - fourth water pump; |
| 25 - water level sensor; | 26 - mud pot; |
| 27 - capturing device; | 28 - chain; |
| 29 - soft tube; | 30 - hard tube. |

DETAILED DESCRIPTION OF EMBODIMENTS

Below, the technical solutions of the present invention will be described clearly and completely in conjunction with figures. Obviously, the described embodiments are part of embodiments of the present invention, but not all embodiments. Based on the embodiments of the present invention, all other embodiments obtained by those ordinary skilled in the art without creative efforts are within the scope of protection of the present invention.

In the description of the present invention, it should be noted that the orientation or positional relationship indicated by the terms "center", "upper", "lower", "left", "right", "vertical", "horizontal", "inner", "outer", etc. are based on the orientation or position relationship shown in the drawings, only for facilitating and simplifying the description of the present invention, but not for indicating or implying that the devices or elements referred to must have the particular orientation or be configured and operated with the particular orientation, and therefore it should not be construed as limitation to the present invention. In addition, the terms "first", "second", "third", etc. are used only for descriptive purpose and not construed to indicate or imply these relative relationships are of importance.

In the description of the present invention, it should be noted that unless otherwise clearly defined and limited, the terms "mount", "connect", "connecting" are to be understood in broad sense, for example, it may be either fixed connection or detachable connection, or may be integrally connected. It may be either mechanical connection or electrical connection; and it may be either directly connected or connected indirectly through an intermediate member, or it may be the internal communication between two elements. For those ordinary skilled in the art, it can be understood that the above terms have specific meanings in the present invention according to specific circumstances.

Embodiment 1

Figure 2:
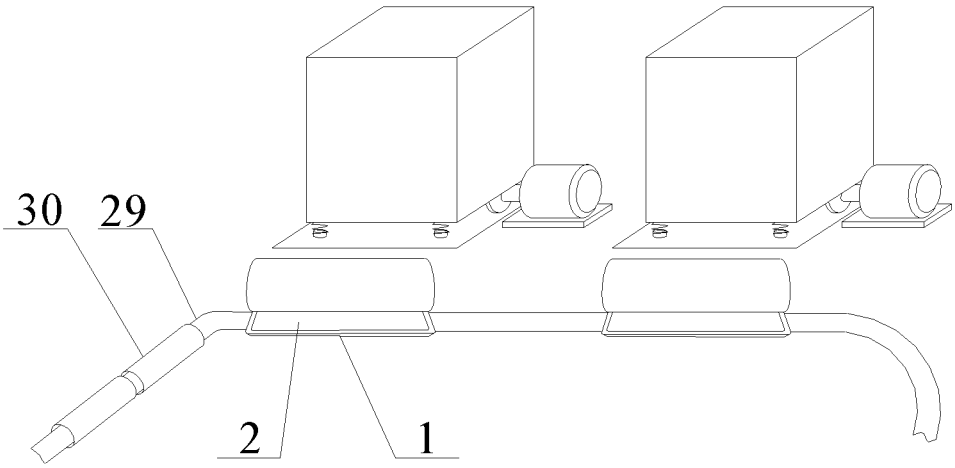
FIG. 2 is a structural schematic diagram of a sand receiver of the automatic rock debris catching and washing apparatus provided by the embodiment of the present invention.
Figure 3:
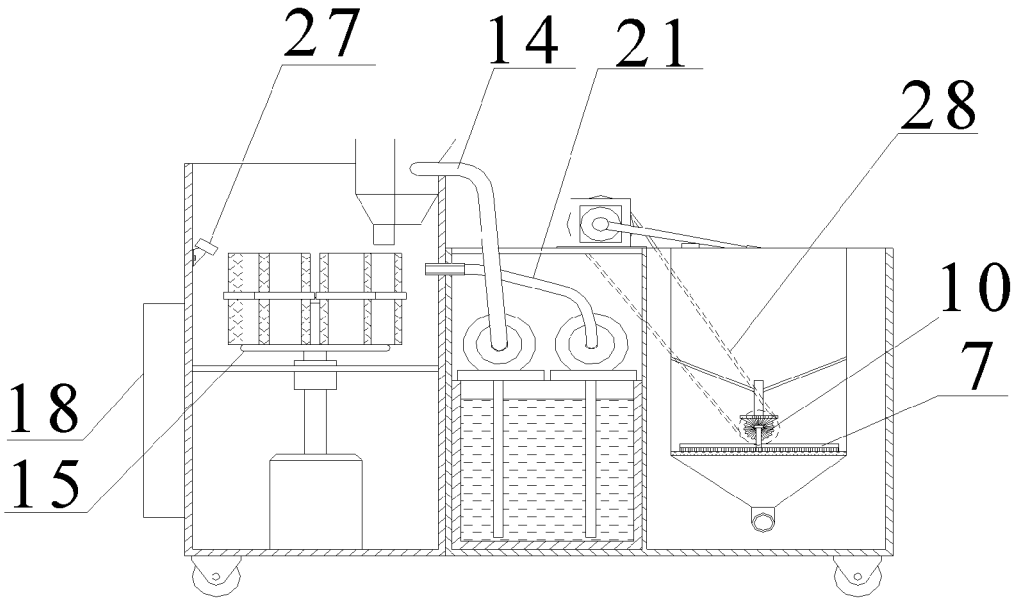
FIG. 3 is a front view of the circulation water tank and the collection water tank of the automatic rock debris catching and washing apparatus provided by the embodiment of the present invention.
Figure 4:
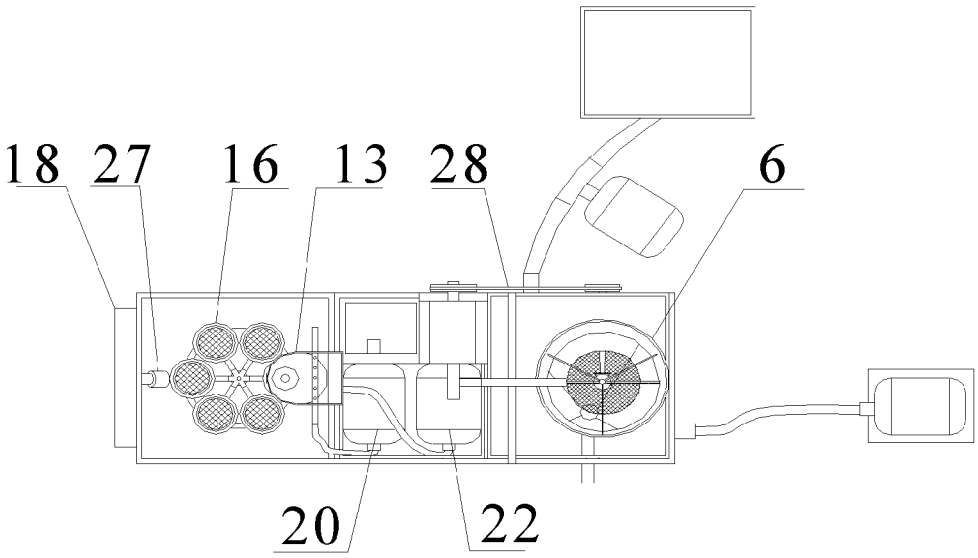
FIG. 4 is a top view of the circulation water tank and the collection water tank of the automatic rock debris catching and washing apparatus provided by the embodiment of the present invention.

FIG. 1 is a structural schematic diagram of a circulation water tank 3 and a collection water tank 12 of an automatic rock debris catching and washing apparatus provided by an embodiment of the present invention; FIG. 2 is a structural schematic diagram of a sand receiver 1 of the automatic rock debris catching and washing apparatus provided by the embodiment of the present invention; FIG. 3 is a front view of the circulation water tank 3 and the collection water tank 12 of the automatic rock debris catching and washing apparatus provided by the embodiment of the present invention; and FIG. 4 is a top view of the circulation water tank 3 and the collection water tank 12 of the automatic rock debris catching and washing apparatus provided by the embodiment of the present invention. As shown in FIGS. 1-4, the automatic rock debris catching and washing apparatus provided by this embodiment comprises an acquisition device, a filtration device, a collection device and a controlling device.

The acquisition device comprises a sand receiver 1, which comprises a rock debris entrance 2 for receiving the rock debris, wherein the rock debris entrance 2 is disposed opposite to a vibrating screen, the sand receiver 1 has a cylindrical shape with two ends are connected respectively to a water inlet and a water outlet, which are respectively connected with pipelines.

The filtration device comprises the circulation water tank 3, the top of which is connected to a first stepping motor 4. An output shaft of the first stepping motor 4 is connected to a swinging arm, the end of which is provided with a sand filter 5 for collecting the rock debris flowing out of the pipeline. A filtering cylinder 6 is provided below the sand filter 5, and an acquisition plate for collecting impurities of the rock debris is provided at the bottom of the filtering cylinder 6. A rock debris brush 7 is provided in the filtering cylinder 6. The circulation water tank 3 is connected to a water discharging pipe 8, one end of which is connected to the water inlet of the sand receiver 1, and the water discharging pipe 8 is provided with a first water pump 9.

Bristles of the rock debris brush 7 are disposed opposite to the acquisition plate, and the rock debris brush 7 is connected to a rotating shaft, which is in turn connected to a driving shaft. A helical gear 10 is between the rotating shaft and the driving shaft. One end of the driving shaft away from the rotating shaft passes through the filtering cylinder 6 and is connected to a driving device. The acquisition plate is connected to a drainage pipe 11.

The collection device comprises a collection water tank 12 interconnecting with the circulation water tank 3. A sand receiving funnel 13 for receiving the rock debris from the sand filter 5 is provided on the collection water tank 12, and the sand receiving funnel 13 is connected to a first fresh water pipe 14. A rotating disk 15 is provided within the collection water tank 12 and positioned below the sand receiving funnel 13. A plurality of sand storing cylinders 16 are arranged on the rotating disk 15 and in a ring arrangement. A second stepping motor 17 is provided at the bottom of the rotating disk 15.

The controlling device comprises a controller 18, which is connected to the first water pump 9, the first stepping motor 4 and the second stepping motor 17, respectively.

When using the automatic rock debris catching and washing apparatus provided by the present invention, the sand receiver 1 is placed at outlet of the vibrating screen, wherein water is made to flow in through the water inlet of the sand receiver 1 and be mixed with the rock debris, and afterwards flow out of the water outlet. The pipeline connected at the water outlet is oblique, and the mixture of the water and the rock debris flows into the filtration device, completing the acquisition of the rock debris.

In the filtration device, the sand filter 5, when in stationary, is directly aligned with the outlet of the pipeline. The mixture of the water and the rock debris flows to the sand filter 5 and then is filtered through the sand filter 5. The impurity particles by the filtering enter the filtering cylinder 6, and the rock debris on the sand filter 5 will go to the next step after the swinging arm is driven by the first stepping motor 4. The impurity particles by the filtering enter the filtering cylinder 6 and are further filtered through the filtering cylinder 6. The impurities by the filtering fall on the acquisition plate. Here, when the swinging arm is driven by the first stepping motor to be rotated, the rock debris brush 7 in the filtering cylinder 6 is driven to be rotated, through a sprocket wheel and a chain 28, and the impurities on the acquisition plate are discharged out, avoiding accumulation. The water accumulated in the circulation water tank 3 is sent again to the water inlet of the sand receiver 1 through the pipeline, realizing reuse of the water.

After the first stepping motor 4 drives the swinging arm to be rotated, the rock debris in the sand filter 5 is transported to the sand receiving funnel 13, and the rock debris on the sand receiving funnel 13 is cleaned by a first fresh water pipe 14. The cleaned rock debris is collected in the sand storing cylinders 16 on the rotating disk 15, and the plurality of sand storing cylinders 16 rotate continuously under the control of the second stepping motor 17 so that the plurality of sand storing cylinders 16 can perform collection.

The operation through the automatic rock debris catching and washing apparatus is a fully automatic operation. During use, it is not necessary to real-time monitor the working condition of the catching and washing apparatus by manpower, and collecting regularly the rock debris gothered within the sand storing cylinders 16 is enough. It is highly adaptable to the harsh environment due to using the mechanized processing, and the interval and rate and so on of collecting the rock debris can be set with high accuracy, making the analysis on the geological conditions more accurate.

Embodiment 2

FIG. 1 is a structural schematic diagram of a circulation water tank 3 and a collection water tank 12 of an automatic rock debris catching and washing apparatus provided by an embodiment of the present invention; FIG. 2 is a structural schematic diagram of a sand receiver 1 of the automatic rock debris catching and washing apparatus provided by the embodiment of the present invention; FIG. 3 is a front view of the circulation water tank 3 and the collection water tank 12 of the automatic rock debris catching and washing apparatus provided by the embodiment of the present invention; and FIG. 4 is a top view of the circulation water tank 3 and the collection water tank 12 of the automatic rock debris catching and washing apparatus provided by the embodiment of the present invention. As shown in FIGS. 1-4, the automatic rock debris catching and washing apparatus provided by this embodiment comprises an acquisition device, a filtration device, a collection device and a controlling device.

The acquisition device comprises a sand receiver 1, which comprises a rock debris entrance 2 for receiving the rock debris, wherein the rock debris entrance 2 is disposed opposite to a vibrating screen, the sand receiver 1 has a cylindrical shape with the two ends respectively connected to a water inlet and a water outlet, which are respectively connected with pipelines.

The filtration device comprises a circulation water tank 3, the top of which is connected to a first stepping motor 4. An output shaft of the first stepping motor 4 is connected to a swinging arm, the end of which is provided with a sand filter 5 for collecting the rock debris flowing out of the pipeline. A filtering cylinder 6 is provided below the sand filter 5, and an acquisition plate for collecting impurities in the rock debris is provided at the bottom of the filtering cylinder 6. A rock debris brush 7 is provided in the filtering cylinder 6, and the circulation water tank 3 is connected to a water discharging pipe 8, one end of which is connected to the water inlet of the sand receiver 1 and the water discharging pipe 8 is provided with a first water pump 9.

Bristles of the rock debris brush 7 are disposed opposite to the acquisition plate, and the rock debris brush 7 is connected to a rotating shaft, which is then connected to a driving shaft. A helical gear 10 is between the rotating shaft and the driving shaft. One end of the driving shaft away from the rotating shaft passes through the filtering cylinder 6 and is connected with a driving device, and the acquisition plate is connected with a drainage pipe 11.

The collection device comprises a collection water tank 12 interconnecting with the circulation water tank 3. A sand receiving funnel 13 for receiving the rock debris from the sand filter 5 is provided on the collection water tank 12, and the sand receiving funnel 13 is connected to a first fresh water pipe 14. A rotating disk 15 is provided within the collection water tank 12 and positioned below the sand receiving funnel 13. And a plurality of sand storing cylinders 16 are arranged, in a ring arrangement, on the rotating disk 15, at the bottom of which a second stepping motor 17 is provided.

The controlling device comprises a controller 18, which is connected to the first water pump 9, the first stepping motor 4 and the second stepping motor 17, respectively.

Further, the catching and washing apparatus further comprises a fresh water tank 19, wherein the first fresh water pipe 14 is connected to the fresh water tank 19, the first fresh water pipe 14 is provided with a second water pump 20 connected to the controller 18.

The fresh water tank 19 provides water for the first fresh water pipe 14, and the second water pump 20 provides power for the first fresh water pipe 14. In particular, during operation, the second water pump 20 is started by the controller 18, and fresh water is supplied by the second water pump 20 to the sand receiving funnel 13 via the first fresh water pipe 14 for cleaning the rock debris, wherein the first fresh water pipe 14 may employ a manner of direct injection to clean the rock debris, or can clean the rock debris by means of spray.

Further, the fresh water tank 19 is connected to a second fresh water pipe 21, on which is provided with a third water pump 22, and the port of the second fresh water pipe 21 is disposed opposite to the bottom of the sand storing cylinders 16.

During the cleaning, after entering the sand receiving funnel 13, the rock debris is cleaned by the first fresh water pipe 14 to make it clean. With the second cleaning performed on the rock debris by the second fresh water pipe 21, the rock debris fallen into the sand storing cylinders 16 are further cleaned through the second fresh water pipe 21. The second fresh water pipe 21 is arranged as directly aligned to the sand storing cylinders 16. During use, the third water pump 22 is started by the controller 18, and the rock debris is cleaned by the water from the fresh water tank 19 by using the second fresh water pipe 21.

Further, the circulation water tank 3 is connected to a water outlet pipe 23, on which a fourth water pump 24 is provided, with the fourth water pump 24 connected to the controller 18.

The top of the inner wall of the circulation water tank 3 is provided with a water level sensor 25, which is connected to the controller 18, and one end of the water outlet pipe 23 is connected to a mud pot 26.

The circulation water tank 3 has the function of storing water and meanwhile sends the stored water to the water inlet of the sand receiver 1, achieving water recycling and reuse, wherein if the water within the circulation water tank 3 is not treated timely, a phenomenon of overflow may occur. Therefore, in order to avoid wasting water source, the water level sensor 25, the water outlet pipe 23 and the fourth water pump 24 are respectively provided in the circulation water tank 3. During use, the water level sensor 25 detects water level information, so as to start the fourth water pump 24 by the controller 18. The fourth water pump 24 draws a portion of the water inside the circulation water tank 3 and conveys it to the mud pot 26, avoiding wasting, wherein the starting time of the fourth water pump 24 can be set to control the amount of water to be drawn, avoiding all of the water inside the circulation water tank 3 being evacuated.

Further, a middle filter screen is provided at the middle of the sand storing cylinder 16, and a bottom filter screen is provided at the bottom thereof. The size of meshes of the middle filter screen is greater than that of the meshes of the bottom filter screen.

The meshes of the middle filter screen are relatively large, thus larger rock debris are collected correspondingly on this middle filter screen, while the meshes of the bottom filter screen are relatively small, thus smaller rock debris are collected correspondingly on this bottom filter screen. It is convenient for post treatment and testing analysis through this manner of layering acquisition.

Further, the catching and washing apparatus further comprises a capturing device 27, which comprises an optical lens disposed opposite to the sand storing cylinders 16.

The capturing device 27 is also equipped with a flash, a focusing device, etc. The capturing device 27 can take pictures of the rock debris under an ordinary incandescent light or an ultraviolet light. The pictures taken can be stored automatically and acquired by manpower periodically, or can be transferred to a specified device to be stored.

Further, along the axial direction of the sand storing cylinder 16, the outer wall of the sand storing cylinder 16 is divided into two portions, including a filter screen portion and a glass portion which is disposed opposite to the optical lens.

If the entire sand storing cylinder 16 is of a mesh structure, the pictures taken by the capturing device 27 may be affected by the mesh structure, thus the sand storing cylinder 16 is divided into the filter screen portion and the glass portion. These two portions are designed in a certain proportion, for example, the filter screen portion accounting for two-thirds of the cylinder and the glass portion accounting for one-third of it, wherein the sand storing cylinders 16 are placed in such a way that the glass portion faces outwards. When they are driven by the second stepping motor 17 to be rotated to correspond to the capturing device 27, the capturing device 27 is exactly aligned with the glass portion, and at this time taking pictures is not affected, and the obtained pictures are clearer.

Further, one end of the driving shaft away from the rotating shaft is provided with a sprocket wheel, and the output shaft of the first stepping motor 4 is provided with a sprocket wheel, with the two sprocket wheels connected through a chain 28.

During use, the swinging arm is driven by the first stepping motor 4 to be swung frequently, wherein the driving shaft connected to the rock debris brush 7 is driven by the output shaft of the first stepping motor 4, thus when the swinging arm rotates, the rotating shaft of the rock debris brush 7 will be driven to operate, so that the rock debris brush 7 removes the impurities on the acquisition plate, playing a role of cleaning.

In this way, it is not necessary to separately provide a driving device for driving the rock debris brush 7, meanwhile the rock debris brush 7 may be frequently operated under the driving of the first stepping motor 4 so as to ensure the cleaning effect, wherein the acquisition plate is connected to a drainage pipe 11, which is disposed obliquely and has the distal end provided with a drainage groove for discharging impurities.

Further, the circulation water tank 3 has a drainage port, which is provided with a solenoid valve.

In the circulation water tank 3, the mixture of water and rock debris is left on the sand filter 5, afterwards the water and the impurities fall into the filtering cylinders 6. The mixture of water and impurities is filtered through the filtering cylinders 6, as the first filtering. The filtering cylinders 6 makes the impurities within the filtering range remain in its interior and they are finally discharged by brushing of the rock debris brush 7, and the water in the circulation water tank 3 is recycled and reused, wherein some minor impurities will still be kept in this part, and there will be accumulation of impurities after being used for long time. The circulation water tank 3 is cleaned again by providing the drainage port and the solenoid valve, and afterwards the waste water is discharged.

Further, the pipelines comprise a soft tube 29, which is connected to the water inlet and the water outlet respectively, and a hard tube 30 is sleeved outside of the soft tube 29. During the transportation of the mixture of rock debris and water, it is possible to avoid the phenomenon of sedimentation, meanwhile it also facilitates adjusting the length of transportation, and adjusting the distance between the sand receiver 1 and the sand filter 5.

When using the automatic rock debris catching and washing apparatus provided by the present invention, the sand receiver 1 is placed at the outlet of the vibrating screen, wherein water is made to flow in through the water inlet of the sand receiver 1 and be mixed with the rock debris and then flow out of the water outlet. The pipeline connected at the water outlet is oblique, and the mixture of the water and the rock debris flows to the filtration device, completing the acquisition of rock debris.

In the filtration device, the sand filter 5, when in stationary, is directly aligned with the outlet of the pipeline. The mixture of the water and the rock debris flows to the sand filter 5 and is filtered through the sand filter 5. The impurity particles by filtering enter the filtering cylinder 6, and the rock debris in the sand filter 5 will go to the next step after the swinging arm is driven by the first stepping motor 4. The impurity particles by the filtering enter the filtering cylinder 6 and are further filtered through the filtering cylinder 6. The impurities by the filtering fall on the acquisition plate. Herein, when the swinging arm is driven by the first stepping motor to be rotated, the rock debris brush 7 in the filtering cylinder 6 is driven to be rotated by a sprocket wheel and a chain 28, and the impurities on the acquisition plate are discharged out, avoiding accumulation. The water accumulated in the circulation water tank 3 is sent again to the water inlet of the sand receiver 1 through the pipeline, realizing the reuse of the water.

After the first stepping motor 4 drives the swinging arm to be rotated, the rock debris in the sand filter 5 is transported to the sand receiving funnel 13 where the rock debris is cleaned by a first fresh water pipe 14. The cleaned rock debris is collected in the sand storing cylinders 16 on the rotating disk 15. The plurality of sand storing cylinders 16 rotate continuously under the control of the second stepping motor 17 so that the plurality of sand storing cylinders 16 can all achieve the collection.

The operation of the automatic rock debris catching and washing apparatus is a fully automatic operation. During use, it is not necessary to real-time monitor the working condition of the catching and washing apparatus by manpower, and collecting regularly the rock debris gathered within the sand storing cylinders 16 is enough. It is highly adaptable to the harsh environment due to using the mechanized processing, and the interval, rate and so on of collecting the rock debris can be set with high accuracy, making the analysis on the geological conditions more accurate.

Finally, it should be noted that the above embodiments merely illustrate the technical solutions of the present invention, but are not intended to limit the present invention. Although the present invention has been described in detail referring to the foregoing embodiments, those skilled in the art will appreciate that the technical solutions described in the foregoing embodiments may be modified, or some or all of the technical features may be equivalently replaced, and such modifications or replacements do not enable the corresponding technical solutions to depart from the scope of the technical solutions of the various embodiments of the present invention.

The invention claimed is:

1. An automatic rock debris catching and washing apparatus, characterized by comprising an acquisition device, a filtration device, a collection device and a controlling device;

the acquisition device comprising a sand receiver, which comprises a rock debris entrance for receiving the rock debris, wherein the rock debris entrance is disposed opposite to a vibrating screen, the sand receiver has a cylindrical shape with the two ends respectively connected to a water inlet and a water outlet, which are respectively connected with pipelines;

the filtration device comprising a circulation water tank, the top of which is connected to a first stepping motor, wherein an output shaft of the first stepping motor is connected to a swinging arm, the end of which is provided with a sand filter for collecting the rock debris flowing out of the pipeline, a filtering cylinder is provided below the sand filter, an acquisition plate for collecting impurities of the rock debris is provided at the bottom of the filtering cylinder, a rock debris brush is provided in the filtering cylinder, and the circulation water tank is connected to a water discharging pipe, one end of which is connected to the water inlet of the sand receiver and the water discharging pipe is provided with a first water pump;

bristles of the rock debris brush being disposed opposite to the acquisition plate, wherein the rock debris brush is connected to a rotating shaft, which is in turn connected to a driving shaft, a helical gear is between the rotating shaft and driving shaft, one end of the driving shaft away from the rotating shaft passes through the filtering cylinder and is connected to a driving device, and the acquisition plate is connected to a drainage pipe;

the collection device comprising a collection water tank interconnecting with the circulation water tank, wherein a sand receiving funnel for receiving the rock debris from the sand filter is provided on the collection water tank, the sand receiving funnel is connected to a first fresh water pipe, a rotating disk is provided within the collection water tank and positioned below the sand receiving funnel, and a plurality of sand storing cylinders are arranged, in a ring shape, on the rotating disk, at the bottom of which a second stepping motor is provided; and the controlling device comprising a controller, which is connected to the first water pump, the first stepping motor and the second stepping motor, respectively.

2. The automatic rock debris catching and washing apparatus according to claim 1, wherein it further comprises a fresh water tank, which is connected to the first fresh water pipe that is provided with a second water pump connected to the controller.

3. The automatic rock debris catching and washing apparatus according to claim 2, wherein the fresh water tank is connected to a second fresh water pipe, which is provided with a third water pump, and the port of the second fresh water pipe is disposed opposite to the bottom of the sand storing cylinders.

4. The automatic rock debris catching and washing apparatus according to claim 1, wherein the circulation water tank is connected to a water outlet pipe, which is provided with a fourth water pump connected to the controller; and a water level sensor is provided on the top of the inner wall of the circulation water tank, with the water level sensor connected to the controller, and one end of the water outlet pipe connected to a mud pot.

5. The automatic rock debris catching and washing apparatus according to claim 1, wherein a middle filter screen is provided at the middle of the sand storing cylinder, and a bottom filter screen is provided at the bottom thereof, the size of meshes of the middle filter screen greater than that of meshes of the bottom filter screen.

6. The automatic rock debris catching and washing apparatus according to claim 1, wherein it further comprises a capturing device, which comprises an optical lens disposed opposite to the sand storing cylinders.

7. The automatic rock debris catching and washing apparatus according to claim 6, wherein along an axial direction of the sand storing cylinder, an outer wall of the sand storing cylinder is divided into two portions, including a filter screen portion and a glass portion which is disposed opposite to the optical lens.

8. The automatic rock debris catching and washing apparatus according to claim 1, wherein one end of the driving shaft away from the rotating shaft is provided with a sprocket wheel, the output shaft of the first stepping motor is provided with a sprocket wheel, and the two sprocket wheels are connected through a chain.

9. The automatic rock debris catching and washing apparatus according to claim 1, wherein the circulation water tank has a drainage port, which is provided with a solenoid valve.

10. The automatic rock debris catching and washing apparatus according to claim 1, wherein the pipelines comprise a soft tube, which is connected to the water inlet and the water outlet respectively, and a hard tube is sleeved outside of the soft tube.

* * * * *